United States Patent [19]

Schwegler et al.

[11] Patent Number: 4,840,353

[45] Date of Patent: Jun. 20, 1989

[54] APPARATUS FOR STUDYING QUENCHING FLUIDS AND QUENCHABILITY OF MATERIALS

[75] Inventors: Patrice Schwegler, Bavans; Jean-Jacques Debrie, Merous-Moval; Bernard Clement, Evette Slabert; Francois Moreaux, Nancy; Jacques Olivier, Jouars-Pontchartrain, all of France

[73] Assignee: Servimetal, Paris, France

[21] Appl. No.: 94,426

[22] Filed: Sep. 9, 1987

[30] Foreign Application Priority Data

Sep. 11, 1986 [FR] France ..... 86 12895

[51] Int. Cl.[4] ..... C21D 11/00

[52] U.S. Cl. ..... 266/80; 266/88

[58] Field of Search ..... 266/78, 80, 287, 87–89, 266/90, 99, 131, 259; 148/128; 73/865.6

[56] References Cited

U.S. PATENT DOCUMENTS 3,517,676 6/1970 Paddock, Jr. ..... 766/131

4,720,310 1/1988 Vlannay ..... 148/128

FOREIGN PATENT DOCUMENTS 8201194 4/1982 European Pat. Off. ..... 266/131

*Primary Examiner*—Christopher W. Brody

*Attorney, Agent, or Firm*—Dennison, Meserole, Pollack & Scheiner

[57] ABSTRACT

The invention concerns an apparatus for studying quenching fluids and quenchability of materials in the form of testpieces 5, comprising a heating furnace, a means for introducing each testpiece into the quenching liquid and extracting the quenched testpiece, a quenching tank 20 containing the quenching fluid and a means for circulating the quenching fluid. According to the invention, the quenching tank 20 comprises an upper tank 21 and a lower tank 22 connected by a means 27 for organizing the circulation, the upper tank being provided with an immersed injector 40 formed by at least one circular array comprising a plurality of radial nozzles and connected to a pressurized fluid source 30, the upper part of the upper tank comprising a conduit 39 for returning the fluid to the pressurization means 30, the lower tank 32 comprising a separate pressurized fluid intake, which apparatus includes means for regulating the temperature of the fluid and means for measuring the speed of the fluid.

19 Claims, 2 Drawing Sheets

APPARATUS FOR STUDYING QUENCHING FLUIDS AND QUENCHABILITY OF MATERIALS

TECHNICAL FIELD OF THE INVENTION

The invention concerns an apparatus for studying cooling fluids and in particular quenching fluids and optimising the conditions for quenching materials and more particularly ferrous and nonferrous metal alloys, and measuring the quenchability thereof.

STATE OF THE ART

It is known that most metal alloys enjoy their highest mechanical properties when they are put into a particular homogeneous structural state which is achieved by a heat treatment comprising a stage for quenching them, from a high temperature, in a fluid which causes cooling thereof at a predetermined rate and under predetermined conditions.

However, if those conditions are not met, that may result in deformation, harmful internal stresses and even shrinkage cracks in the quenched components. It is therefore important to know the quenching conditions and to produce them in a very precise manner.

The quenching operation is generally carried out in a liquid medium which, depending on the desired cooling rates, may be of the aqueous, oily or igneous (molten salt) type.

When a component which has been previously raised to elevated temperature is quenched in a vaporisable fluid, the cooling action takes place in three separate stages corresponding to decreasing temperatures, as follows:

the first stage corresponds to 'calefaction'. The component is surrounded by a sheath of vapour which insulates it from the quenching fluid and retards the rate of cooling;

the second stage corresponds to nuclear boiling, that is to say the appearance of bubbles of vapour on a large number of points on the component; and finally, the third stage corresponds to cooling by conduction and convection by virtue of direct contact between the quenching fluid and the component.

The quality of a quenching medium may be evaluated by means of a test which comprises taking a standard testpiece of metal which is a good conductor of heat and/or which does not exhibit any allotropic transformation in the temperature range in question (for example silver), within which a temperature sensor is disposed, raising it to high temperature in a controlled furnace, immersing it immediately it is removed from the furnace in the quenching medium and recording the variation in its temperature in dependence on time.

In that way, for each quenching medium and with the same initial temperature, it is possible to plot series of curves representing temperature versus time and cooling speed versus temperature (derived curve) which makes it possible objectively to evaluate the qualities and defects of said media (such curves are referred to as 'drasticity curves').

At the present time, the quenching agents which are most widely used are mineral or vegetable oils but the trend is for them to be replaced by aqueous fluids based on water-soluble polymers such as polyvinyl alcohol, polyoxyalkylene glycols, polyacrylic alcohols and polyvinylpyrrolidone (French patents Nos. 2 507 209, 2 537 997, 2 537 998 and 2 538 002 (SERVIMETAL).

Therefore, from the point of view of the quenching expert, it is very useful to have a piece of equipment which makes it possible to test precisely and in a reproducible fashion both metal alloys or other new materials, in relation to known quenching agents, as well as new quenching agents in relation to reference materials, under conditions which are as close as possible to industrial uses.

SUBJECT-MATTER OF THE INVENTION

The subject-matter of the invention is an apparatus for studying quenching fluids and the mixing thereof and quenchability of materials, in the form of testpieces, comprising a furnace for heating said testpieces, a means for introducing each testpiece into the quenching liquid and extracting the quenched testpiece, a quenching tank containing the quenching fluid and a means for circulating the quenching fluid.

In accordance with the invention, the quenching tank comprises an upper tank and a lower tank which are connected by a means permitting the circulation and distribution of the fluid to be organised and the speed thereof to be established, the upper tank being provided with an immersed injector formed by at least one circular array comprising a plurality of radial nozzles which are directed towards the axis of the tank and connected to a pressurised fluid source, the upper part of the upper tank comprising a conduit means for returning the fluid to the pressurisation means, the lower tank comprising a separate pressurised fluid intake and a means for monitoring and regulating the temperature of the fluid. That apparatus thus makes it possible to determine optimum stirring and mixing of a fluid with respect to a given component and a given material.

Figure 1:
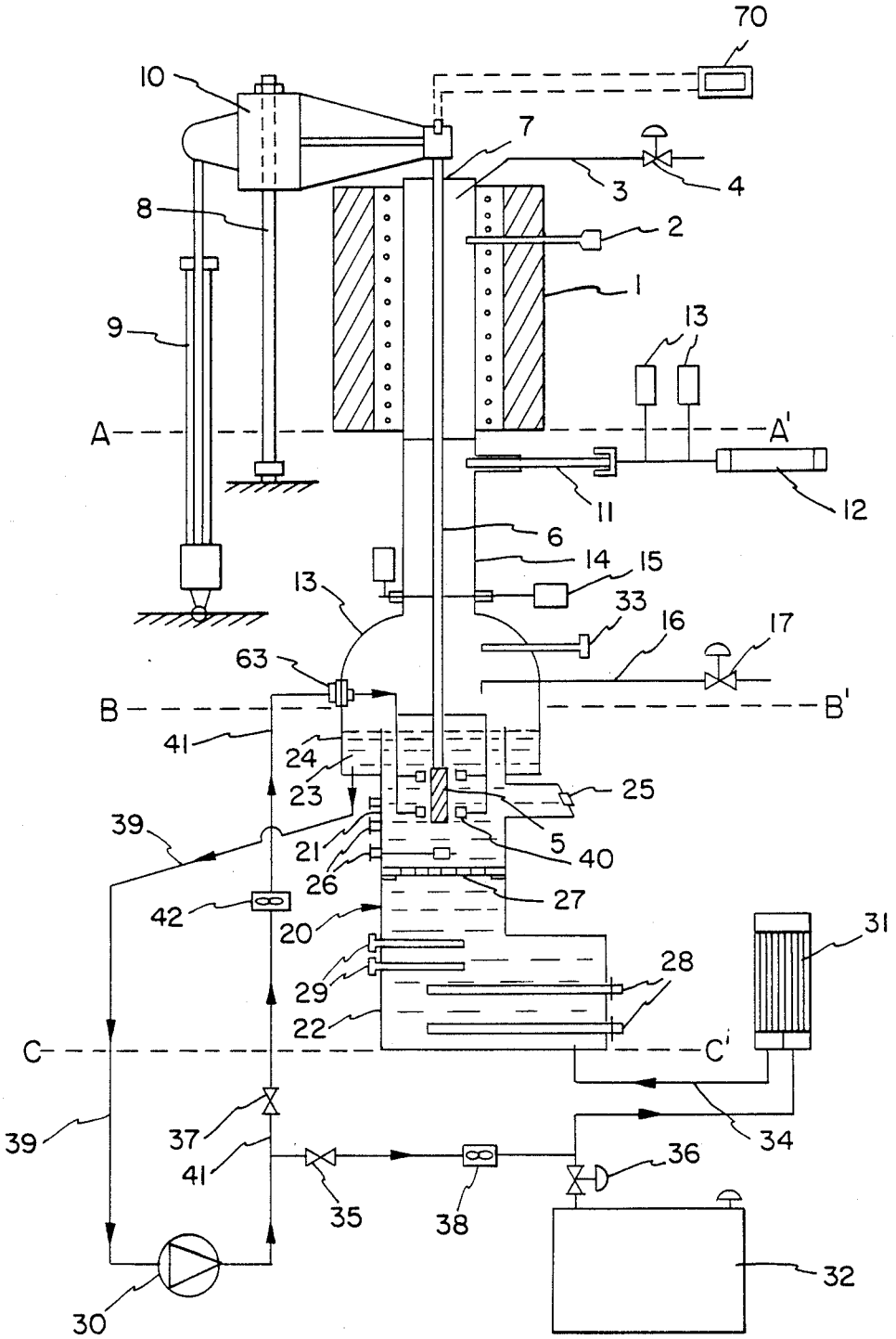
FIG. 1 is a diagrammatic view in vertical section of the whole of the apparatus.

The apparatus according to the invention essentially comprises four parts: the heating furnace (above the line AA'), the loading station (between lines AA' and BB'), the quenching tank (and the heat exchanger) (between lines BB' and CC') and the system for stirring the quenching fluid, as well as the safety tank (the lower part in FIG. 1, below the line CC').

1. The heating furnace 1 with electrical resistance means makes it possible to achieve temperatures ranging from ambient temperature to 1200° C. In an embodiment of the invention, the power thereof is 1400 watts, while its inside diameter is 70 mm and its length is 200 mm, so as to permit different testpieces which are in current use to be treated: a silver testpiece $\phi 8$, L 24 and $\phi 16$, L 48 mm, testpiece 'U', $\phi 35$, L 105 mm, or special testpieces such as the testpiece which is referred to as a 'wedge' testpiece, with a diameter of 30 mm, a length of 100 to 105 mm, cut in a wedge shape, with an angle at the apex of 20°, of steel 38C2, as developed by the present applicants.

The temperature is measured, displayed and regulated, from the thermocouple 2. A conduit 3 provided with a valve 4 permits an inert gas such as nitrogen or a nitrogen-hydrogen mixture to be injected into the furnace.

During the heating operation and then during the quenching operation, the testpiece 5 to be tested is supported by a rod 6 which passes through the upper plate 7 which closes off the furnace by way of an orifice with a small amount of clearance, with the upward and downward movement thereof being controlled by a hydraulic jack 8.

A second jack 9 permits the head 10 which supports the rod 6, in the course of the quenching operation, to be subjected to a vertical vibratory movement, the function of which will be more clearly set forth hereinafter.

The lower part of the furnace is also provided with a closure slider 11 which is controlled by the jack 12. The safety locks 13 permit the movement of the slider 11 to be dependent on the downward movement of the testpiece 5.

2. The loading station is formed by a bell 13 which caps the quenching tank, thus permitting the quenching fluid to be protected by means of nitrogen. Such protection is indispensable when the fluid is an oil which is raised to elevated temperature (up to 250° C.); the bell 13 is connected to the furnace by a connecting tube 14 formed by two half-cylinders which are removable or which open by rotary movement about a vertical hinge axis. The opening movement of the tube 14 is synchronized with that of the flap 15 for isolating the bell, thus permitting a testpiece to be introduced or removed while maintaining the nitrogen atmosphere over the quenching fluid. Nitrogen is introduced into the bell by way of the conduit 16 which is controlled by the valve 17.

3. The quenching tank 20 consists of two parts: the upper tank 21 and the lower tank 22. The upper tank 21 is formed by a cylinder which in its upper portion is provided with an overflow ring 23 whose outside peripheral portion 24 is sealingly connected to the bell 13. It further comprises an aiming port 25 disposed at the level of the testpiece 5 when it is undergoing quenching, and a certain number of 'tapping openings' 26 (three thereof are illustrated) which make it possible to install sensors for sensing temperature and/or speed of the quenching fluid, by way of a sealing joint. Finally the upper tank comprises the device 40 for the direct injection of fluid by way of nozzles which are distributed around the testpiece. It will be described hereinafter.

The lower tank 22 is separated from the upper tank 21 by a particular apparatus for controlling the distribution and the speed of the fluid such as the grille 27, the function of which will be referred to in greater detail hereinafter.

The lower tank further comprises electrical heating elements of hairpin-like configuration, as indicated at 28 (immersion heaters) and sensors for sensing temperature and/or speed of the fluid, as indicated at 29, which are adjustable in respect of position.

The system for stirring and mixing the quenching fluid makes it possible to provide both for overall agitation and immersed injection. It is formed by the following:

a circulating pump 30 which has a high hourly output, for example of the order of 50 to 200 times the total fluid capacity (tanks+conduit means), a plate-type exchanger 31.

Taking account of the range of temperatures of the quenching fluids (from ambient temperature up to 250° C.), it is necessary to provide for mixed regulation by heating (resistance means 28) and cooling (heat exchanger 31). That regulation effect, of the PID (proportional/integral/differential) type provides a degree of accuracy of ±1° C. in respect of the temperature of the fluid, a rapid emptying tank 32 which is provided as a safety measure, having regard to the fact that most of the quenching oils are inflammable, particularly when they are raised to a temperature of 200° C. or 250° C.

Rapid emptying may be effected manually (that control mode is referred to as 'punch-cut' control) or automatically by virtue of the detection of a rise in temperature in the bell (sensor 33). The rapid emptying operation may be accompanied by injection into the bell 13 of nitrogen or an extinguishing gas, for example a fluorocarbon gas, by way of the pipe 16 and the valve 17, an assembly of conduits and control valves permitting the fluid, to be injected under pressure:

only into the lower tank 22 by way of the conduit 34, valve 35 open, 36 closed and 37 closed, with the flow rate being measured by the rotameter 38, and with return by way of the conduit 39 to the pump 30 (that circuit is referred to as the 'overall agitation' circuit), or only in the injectors 40 by way of the conduit 41, with the valves 35 and 36 closed and the valve 37 open, with the flow rate being measured by means of the rotameter 42, the fluid being returned by overflowing into the ring portion 23 and being removed by way of the conduit 39 (that circuit is referred to as the immersed injection circuit), or in the two circuits at the same time, by opening the valves 35 and 37 (the valve 36 remaining closed).

The means for circulating and agitating the quenching fluid with respect to the testpiece is one of the essential points of the invention.

It was important for such circulation and agitation effect to be not only of maximum effectiveness, but also for the effects thereof to be controlled, measurable and reproducible, irrespective of the fluid used and irrespective of the nature of the testpiece.

The circulation operation therefore involves two means which are shown in FIGS. 2, 3, 3A, 4, 4A and 4B.

1. Circulation of fluid around the testpiece 5 from the lower tank 22. The simple system of a grille 27, see FIG. 1, irrespective of its position (in respect of height) in relation to the testpiece, does not guarantee true convergence of the flows of fluid circulation around the testpiece. That system is suitable only in a limited number of cases.

Figure 2:
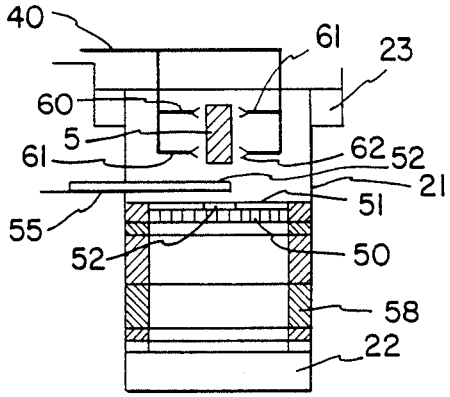
FIGS. 2, 3, 3A, 4, 4A and 4B are views in vertical section of details of the apparatus for controlling the distribution of the fluid.

In FIG. 2, the simple grille has teen replaced by a separator 50 of honeycomb configuration with cavities of square section with a side of 10 mm, above which is mounted a closure plate 51 provided with an opening 52 whose diameter is adapted to that of the testpiece: for example of the order of 30 to 60 millimeters for the most widely used testpieces. In practice, the diameter of the passage for the flow of fluid must be at least equal to the diameter of the testpiece and is preferably between 1 and 5 times that diameter.

The honeycomb ducts promote the formation of parallel flows of fluid which reach the testpiece before having substantially diverged and thus provide for a quasi-laminar flow and a high rate of circulation around the testpiece, and thus a highly effective cooling action.

Figure 3A:
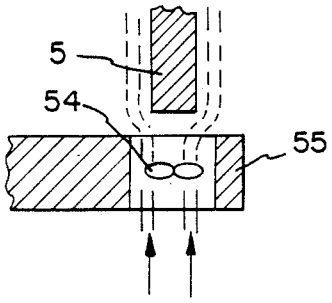
Figure 3:
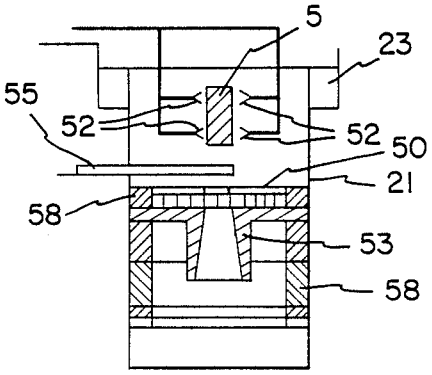

In FIG. 3 the lower part of the separator 50 supports a convergent cone 53 which increases the rate of circulation of the fluid, by way of the reduction in flow sections.

FIG. 3A which is a view on an enlarged scale of part of FIG. 3 shows the position of the propeller 54 of the rotameter 55 with respect to the testpiece 5. The rotameter 55 may be in position or withdrawn, in the course of a test, as desired.

Figure 4:
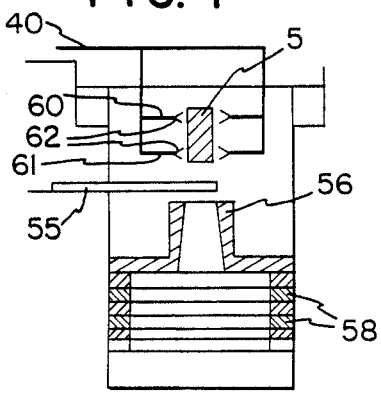
Figure 4A:
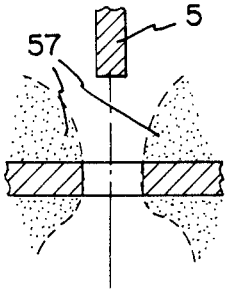
Figure 4B:
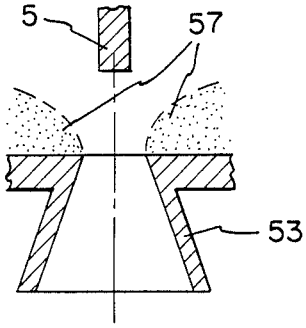

Finally, in FIG. 4, the honeycomb separator has been removed and the assembly uses only a convergent cone 56 which has the advantage of largely eliminating the dead zones 57 in which the fluid circulates not at all or only slightly, in the vicinity of the testpiece 5.

The packing members 58 make it possible for the height of the cone 56 with respect to the testpiece to be regulated (after dismantling).

2. The second means for circulating the fluid around the testpiece is formed by the immersed injector 40. In the particular construction illustrated, the injector comprises two superposed arrays 60 and 61 which are each provided with three nozzles 62 which are displaced relative to each other at 120° and which are possibly interchangeable to vary the flow rate the form of the flow of fluid injected.

Likewise, the whole of the injector 40 can be dismantled and interchanged by virtue of the dismantleable connection 63 (see FIG. 1).

Finally, the quenching effect can be modified by subjecting the support rod 6 and therefore the testpiece 5 itself to a vibration movement of predetermined frequency and amplitude under the action of the vibration-generating jack 9, for example in order to slow down or destabilise the calefaction effect.

The above-mentioned mechnaical vibration of the testpiece may be completed or replaced by an ultrasonic generator of conventional type, of piezoelectric or magneto-striction effect, the emission of which is focussed on the testpiece.

The installation generally is completed by measuring means. Measurement and regulation of the various temperatures (furnace and fluid) have already been referred to.

A particularly important measurement is the measurement of the temperature of the testpiece which is carried out at two points (centre and surface) to measure the thermal gradient, by means of thermocouples of small dimensions which are disposed in orifices bored in the testpiece at suitably selected locations and connected by way of the support rod 6 to a recording means 70 which directly plots the temperature-time curve and the derivative thereof (rate of cooling versus time) in the course of the test.

The speed of circulation of the quenching fluid is measured at various points on the circuits and in the upper and lower tanks by means of screw-type rotameters. That measurement is based on the variation in a current induced by the rotation of a two-blade screw or propeller 54 in front of a detector. The measurement produced is relatively accurate in the range of from 0.1 to 7 m.s.$^{-1}$. The rotameters 38 and 42 are fixed. Others are removable and/or displaceable, such as those which correspond to reference 29 in FIG. 1 or those as indicated at 55 which can be disposed by way of tapping openings 29 between the means 27 and the testpiece 5, or at the level of the nozzles 62.

CARRYING THE INVENTION INTO EFFECT

A test apparatus corresponding to the foregoing description and FIG. 1 was constructed, with the fluid being circulated from the lower tank to the testpiece in accordance with the alternative construction shown in FIG. 4. The quenching tank has a total capacity of 50 liters, plus 20 liters for the whole of the outside circuits. The circulating pump has a maximum flow rate of 10 m$^3$/h. The operation of setting the testpiece 5 in position at the end of the rod 6, at the location of the cylinder 14 (loading station) is a manual one. The whole of the remainder of the cycle is automatic. Transfer and positioning of the testpiece are effected by means of the jack 8 which is controllable in respect of speed and position and which is controlled by two timing devices, one giving the heating time (rise in temperature and then a temperature plateau), while the other gives the time of immersion in the fluid, in accordance with the following cycle:

A: loading station (starting point)

B: transfer into the furnace and rise in temperature

C: transfer into the quenching tank (at controlled and adjustable speed)

D: return to the unloading station and the resumption of a fresh cycle.

In order to evaluate the effectiveness of circulation and agitation of the fluid around the testpiece, the rate of circulation of the fluid was measured by means of the rotameter 55 disposed in the vicinity of the testpiece (FIG. 3A) and more particularly between the upper portion 59 of the convergent member 56 and the base of the testpiece 5, the latter being of the type SFB (silver, flat bottom $\phi$16 mm L 48 mm) and at the location of the injection nozzles 62 by means of a rotameter which is set in position by way of a tapping opening 26.

Those measurements were made in the following different cases:

'TRATHER' oil (from the company MILLOIL) at 50°, 80° and 150° C.,

'TO10' oil (from the company MOTUL), at 50° and 80° C.

pure water at 20° C.

water with the addition of 1.25% by weight of polyvinyl pyrrolidone (PVP) at 20° C.

| FLUID | TEMP. °C. | VISCOSITY IN cst (mm$^2$ · s$^{-1}$) | MEASURED SPEED IN ms$^{-1}$ With rotameter (50) | Nozzle outlet (62) $\phi$1 mm | Nozzle outlet (62) $\phi$3 mm |
|---|---|---|---|---|---|
| Oil | 50 | 40 | 0.66 | 23 | 21 |
| Trather | 80 | 14 | 0.96 | 24.8 | 21.8 |
| Oil TO10 | 50 | 29 | 0.91 | 23.5 | 21 |
| | 80 | 4.5 | 1.07 | 24.4 | 22.2 |
| Pure water | 20 | 1 | 1.11 | 24.4 | 21 |
| Water + 1.25% PVP | 20 | 2.2 | 1.05 | nd | nd |

Those elevated speeds are substantially higher than can be achieved under the usual industrial conditions. In addition, it should be noted that they increase by 3 to 17% when the testpiece 5 is removed and therefore greatly exceed the meter per second for oils at 80° C. at the location of the rotameter 55. In the connecting conduits, the measured speeds are of the order of 3.3 to 3.5 m.s$^{-1}$ (rotameters 42 and 38). The apparatus according to the invention therefore makes it possible to study both the behaviour of quenching fluids of oily or aqueous type with respect to reference testpieces, and the quenchability of materials such as metal alloys, and thus to establish the drasticity curves for a given quenching fluid and for given heat treatment conditions, in a precise and reproducible fashion. It also makes it possible to study and determine a priori and to optimise the conditions for quenching and stirring of the fluid for a given, known or new material.

We claim:

1. Apparatus for studying quenching fluids and the stirring thereof and quenchability of materials in the form of testpieces (5), comprising in combination: a furnace (1) for heating said testpieces, means for introducing each testpiece into the quenching liquid and extracting the quenched testpiece, a quenching tank (20) containing the quenching fluid, and means for circulating the quenching fluid by a pump and associated conduits, wherein the quenching tank (20) comprises an upper tank (21) and a lower tank (22) which are connected by means (27) for organising the circulation and distribution of the fluid and establishing the speed thereof, the upper tank being provided with an immersed injector (40) formed by at least one circular array comprising a plurality of radial nozzles (62) directed towards the axis of the tank and connected to a pressurised fluid source (30), the upper portion of the upper tank comprising a conduit (39) for the return of fluid to the pressurisation means (30), the lower tank (22) comprising a separate pressurised fluid intake, means for monitoring and regulating the temperature of the fluid, and means for measuring the speed of circulation of the fluid.

2. Apparatus according to claim 1, including programmable means for providing for establishing a rise in temperature of the testpiece (5) in the furnace (1), maintaining the thermal plateau at the selected temperature of the testpiece, effecting the downward movement of the testpiece (5) into the quenching fluid and the positioning thereof in the upper tank (21), and effecting the upward movement of the testpiece at the end of a quenching operation.

3. Apparatus according to claim 1 or 2, wherein the testpiece (5) is fixed to the lower end of a rod (6) whose upper portion is connected by a head (10) to a linear jack (8) and to a vibrating jack (9).

4. Apparatus according to claim 1 or 2, further comprising an ultrasonic generator for vibrating the testpiece (5).

5. Apparatus according to claim 1 or 2, wherein the testpiece (5) is formed by a cylinder of steel 38C2, of a diameter of 30 mm and a length of between 100 and 105 mm, cut in a wedge shape, with an angle at the apex of 20°.

6. Apparatus according to claim 1, wherein means (27) is formed by a perforated grille.

7. Apparatus according to claim 1, wherein means (27) is formed by a honeycomb grille (50) provided in its upper part with a diaphragm (51) having an axial orifice whose diameter is at least equal to the diameter of the testpiece and is preferably betweeen one and five times said diameter.

8. Apparatus according to claim 6 or 7, wherein means (27) further comprises a convergent cone (53).

9. Apparatus according to claim 1, wherein means (27) is formed by a convergent cone (53) whose upper opening (59) is of a diameter at least equal to that of the testpiece and preferably between 1 and 5 times said diameter.

10. Apparatus according to claim 6, 7 or 9, wherein means (27) comprises packing means (58) for regulating its position with respect to the testpiece (5).

11. Apparatus according to claim 1, including means disposed above the upper tank (21) comprising a sealed bell (13) comprising an inert gas intake (16, 19) and connected in its upper part in sealing relationship to the lower part of the furnace (1) by a loading station (14).

12. Apparatus according to claim 1 or 11, wherein the upper part of the upper tank (21) comprises a peripheral overflow ring (23) whose outside portion (24) is connected in sealing relationship to the lower part of the bell (13) and said overflow ring is connected to the return conduit (39).

13. Apparatus according to claim 1, wherein said means for monitoring and regulating the temperature of the fluid comprises heating resistance means (28) disposed in the lower tank and controlled by a thermostat (28) and an external plate-type exchanger (31).

14. Apparatus according to claim 1, comprising screw-type rotameters (38, 42) in the connecting conduits.

15. Apparatus according to claim 1, comprising displaceable or removable rotameters in the upper tank (21) or in the lower tank (22), at least one of said rotameters (55) being placed between the orifice of the means (27) and the testpiece (5).

16. Apparatus according to claim 1, comprising means (36, 32) for rapid emptying of the quenching fluid, said rapid emptying means being connected to the detector (33) for detecting an abnormal rise in temperature in the bell (13).

17. Apparatus according to claim 3, further comprising an ultrasonic generator for vibrating the testpiece (5).

18. Apparatus according to claim 3, wherein the testpiece (5) is formed by a cylinder of steel 38C2, of a diameter of 30 mm and a length of betwen 100 and 105 mm, cut in a wedge shape, with an angle at the apex of 20°.

19. Apparatus according to claim 8, wherein means (29) comprises packing means (58) for regulating its position with respect to the testpiece (5).

* * * * *